US005178521A

United States Patent [19]

Ikeda et al.

[11] Patent Number: 5,178,521

[45] Date of Patent: Jan. 12, 1993

[54] SWASH PLATE TYPE COMPRESSOR WITH A CENTRAL DISCHARGE PASSAGE

[75] Inventors: Hayato Ikeda; Toshiro Fujii; Hideo Mori; Kazuo Murakami; Katsunori Kawai; Kazuaki Iwama, all of Kariya, Japan

[73] Assignee: Kabushiki Kaisha Toyoda Jidoshokki Seisakusho, Kariya, Japan

[21] Appl. No.: 863,814

[22] Filed: Apr. 6, 1992

[30] Foreign Application Priority Data

Apr. 23, 1991 [JP] Japan ..... 3-092158
Apr. 30, 1991 [JP] Japan ..... 3-098705

[51] Int. Cl.[5] ..... F04B 1/16

[52] U.S. Cl. ..... 417/269; 91/502; 92/71; 184/6.17

[58] Field of Search ..... 417/269, 271, 222 R; 92/71, 110; 184/6.17; 91/499, 502; 123/58 BB

[56] References Cited

U.S. PATENT DOCUMENTS 3,079,869 3/1963 Purcell ..... 91/501
3,888,604 6/1975 Oshima et al. ..... 417/269
5,052,898 10/1991 Cook ..... 417/269

FOREIGN PATENT DOCUMENTS 54-55809 5/1979 Japan .

*Primary Examiner*—Leonard E. Smith
*Attorney, Agent, or Firm*—Brooks Haidt Haffner & Delahunty

[57] ABSTRACT

A swash plate type compressor comprising a swash plate accommodated in a swash plate chamber. Front and rear housings are attached to the cylinder block to form suction chambers and discharge chambers, respectively. A refrigerating medium is introduced from a suction inlet to the suction chambers via the swash plate chamber and discharged from the discharge chambers. A drive shaft is fixed to the swash plate for reciprocally moving pistons. The drive shaft has a discharge passage in the form of an axial bore formed in the drive shaft for connecting the front discharge chamber to the rear discharge chamber. The discharge passage is thus isolated from the suction system.

17 Claims, 8 Drawing Sheets

SWASH PLATE TYPE COMPRESSOR WITH A CENTRAL DISCHARGE PASSAGE

BACKGROUND OF THE INVENTION

1. Field of the Invention

The present invention relates to a swash plate type compressor adapted for use in an automobile refrigerating system.

2. Description of the Related Art

A swash plate type compressor has a rotatable swash plate and a plurality of pistons reciprocally moved by the swash plate. Japanese Unexamined Patent Publication (Kokai) No. 54-55809, for example, discloses a swash plate type compressor comprising a cylinder block, a rotatable swash plate and a plurality of pistons arranged in the cylinder block. The cylinder block in this Publication is formed by a front block half and a rear block half coupled together, and has at the juncture of the front and rear block halves a swash plate chamber accommodating and a suction inlet receiving a refrigerating medium from a refrigerating circuit. The swash plate chamber communicates with the suction inlet so that a lubricating oil contained in the refrigerating medium is supplied to the swash plate. The outer ends of the front and rear block halves are covered by front and rear housings, respectively, via valve plates. Each of the front and rear housing has a suction chamber and a discharge chamber formed therein, and a discharge outlet is formed in the rear housing for delivering the refrigerating medium to the refrigerating circuit. The discharge chamber of the rear housing is directly connected to the discharge outlet and the discharge chamber of the front housing is connected to the discharge outlet of the rear housing via a discharge passage.

A drive shaft extends in a central bore in the cylinder block and rotatably supported therein by radial bearings and seal elements. The swash plate is fixed to the drive shaft and accommodated in the swash plate chamber. The front and rear block halves have a plurality of pairs of front and rear working bores, each pair extending parallel to each other around the central axial bore. A plurality of double headed pistons are inserted in the respective pairs of the working bores for forming compression chambers in the working bores, respectively, and engaged with the swash plate via the shoes. Each of the valve plates has suction ports with associated valve elements for introduction of the refrigerating medium from the suction chamber of each housing to the compression chambers, and discharge ports with associated valve elements for discharge of the compressed medium from the compression chambers to the discharge chambers of the housings. Each of the front and rear block halves has a plurality of suction passages at a radially inner region of the block halves for introduction of the medium from the swash plate chamber to the suction chambers, while the discharge passage is arranged at a radially outer region of the block halves.

In this swash plate type compressor, the refrigerating medium is introduced from the refrigerating circuit into the swash plate chamber via the suction inlet, and then from the swash plate to the front and rear suction chambers. The rotation of the drive shaft is transferred to the reciprocating movement of the pistons via the swash plate. Accordingly, the refrigerating medium is sucked from each suction chamber to the compression chambers via the suction ports of the valve plates in the suction stroke of the pistons. Then the compressed refrigerating medium is discharged from the compression chambers to the discharge chambers in the front and rear housings via the discharge ports in the compression stroke. The compressed refrigerating medium in the discharge chamber in the front housing is delivered to the rear housing via the discharge passage and the compressed refrigerating medium from the front and rear discharge chambers is collected at the rear housing. The collected refrigerating medium is finally discharged from the discharge outlet to the refrigerating circuit for recirculation through the refrigerating circuit.

In the conventional swash plate type compressor, the discharge passage connecting the discharge chamber in the front housing to the rear housing must be arranged in the cylinder block in such a position that the discharge passage does not interfere with the working bores, the swash plate chamber, and the suction passages. Therefore, the discharge passage was arranged at a radially outer region of the block halves. In addition, there is a requirement to minimize the size of the compressor, and to satisfy this requirement, the discharge passage will approach the working bores, the swash plate chamber, or the suction passages. Accordingly, the refrigerating medium introduced from the refrigerating circuit in the compressor via the suction inlet and flowing through the swash plate chamber and the suction passages, is apt to be heated by the compressed and thus hot refrigerating medium flowing through the discharge passage. Then thus heated refrigerating medium is sucked in the compression chambers and compressed therein, resulting in an increase in the temperature of the compressed refrigerating medium. Therefore, the hot refrigerating medium is delivered to the refrigerating circuit at which the refrigerating medium is to be condensed, and the load of the refrigerating circuit becomes heavy and the refrigerating capacity is decreased.

The radial bearings and seal elements rotatably supporting the drive shaft are also lubricated by a mist of lubricating oil contained in the refrigerating medium flowing through the swash plate chamber the suction chamber, or the discharge chamber. However, the amount of the lubricating oil supplied to the radial bearings and seal elements is almost constant even though the revolution of the drive shaft changes, and there is a problem in that the radial bearings and seal elements may be subjected to poor lubrication when the revolution of the drive is high.

SUMMARY OF THE INVENTION

The object of the present invention is to solve the above described problems and to provide a swash plate type compressor in which the temperature of the discharged refrigerating medium can be reduced compared with that in conventional compressors.

Another object of the present invention is to provide a swash plate type compressor in which radial bearings and seal elements can be suitably lubricated when the revolution of the drive shaft changes.

According to the present invention, there is provided a swash plate type compressor comprising a cylinder block having opposite ends, a central axial bore; a plurality of working bores extending parallel to each other around the central axial bore, a suction inlet, and a swash plate chamber intersecting the central axial bore and the working bores; valve plates attached to the ends of the cylinder block, respectively; the valve plates having valve ports and associated valve elements to cover and uncover the valve ports; first and second housings attached to the ends of the cylinder block over the valve plates, respectively; each of the first and second housings having at least a discharge chamber formed between each of the first and second housings and each of the valve plates; a drive shaft inserted in the central axial bore of the cylinder block and rotatably supported therein; a swash plate accommodated in the swash plate chamber and fixed to the drive shaft for rotation therewith; a plurality of double headed pistons inserted in the respective working bores for forming compression chambers in each of the working bores on either side of each of the double headed pistons and engaged with the swash plate via shoes so that the pistons reciprocally move in the respective working bores upon a rotation of the swash plate; at least one suction passage for introducing a medium from the suction inlet to the compression chambers via the swash plate chamber, and a discharge passage for connecting the discharge chamber in one of the first and second housings to the other housing having the discharge outlet; wherein the discharge passage is arranged at least partly in the drive shaft.

With this arrangement, the compressed medium in the discharge chamber in one of the first and second housings is delivered to the other housing via the discharge passage formed in the drive shaft and the collected medium from the first and second housings are discharged from the discharge outlet to a refrigerating circuit for recirculation through the refrigerating circuit.

In this swash plate type compressor, the discharge passage is isolated from the suction system compared with the prior art and accordingly the medium introduced from the suction inlet flows through the swash plate chamber and the suction passages are less affected by the heat of the compressed hot medium flowing through the discharge passage. Therefore, the medium of a relatively low temperature is sucked in the compression chambers and the temperature of the discharged medium is low.

Preferably, the drive shaft has opposite ends, an intermediate point, a solid shaft portion extending from one of the ends to the intermediate point, and a hollow shaft portion extending from the intermediate point to the other end, the hollow shaft portion having an axial hole and at least one radial hole for constituting the discharge passage in which the axial hole has an open end at the other end, and the at least one radial hole opens in the discharge chamber other than that having the discharge outlet.

Preferably, at least one radial hole has guide means for assisting a flow of the medium from the discharge chamber into the axial hole of the hollow shaft portion upon the rotation of the drive shaft. With this arrangement, the compressed refrigerating medium is suitably guided from the discharge chamber into the discharge passage in the drive shaft upon the rotation of the drive shaft and discharge resistance is decreased.

Also preferably, at least one bearing is arranged in the central axial bore of the cylinder block about the drive shaft between the intermediate point and the other end of the drive shaft, and the hollow shaft portion has at least one oil hole near the bearing for lubricating the bearing with an oil contained in a medium to be compressed. Also, a means is arranged in the hollow shaft portion of the drive shaft at a position on the upstream side of the bearing to produce a turbulent flow of the refrigerating medium flowing in the discharge passage in the drive shaft. With this arrangement, the radial bearing rotatably supporting the drive shaft is lubricated by a mist of lubricating oil contained in the medium flowing through the discharge passage in the drive shaft. A turbulent flow and a centrifugal force in the discharge passage occurs with the rotation of the drive shaft, so that the amount of the lubricating oil supplied from the oil hole to the bearing increases generally in proportion to the revolution of the drive shaft. Accordingly, the radial bearing can be suitably lubricated when the revolution of the drive shaft changes.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
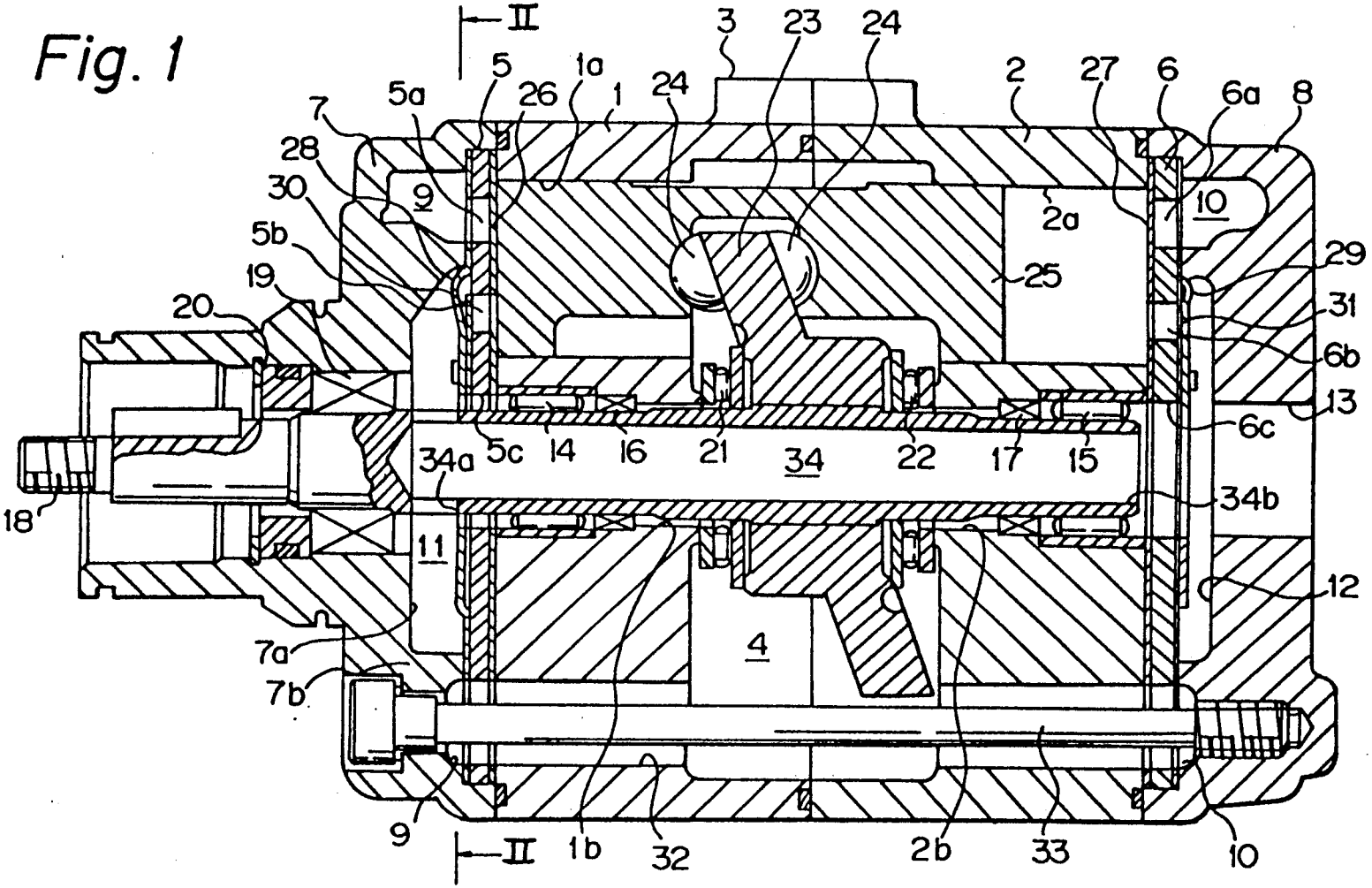
FIG. 1 is a cross-sectional view of a swash plate type compressor according to the first embodiment of the present invention.

FIG. 1 shows a swash plate type compressor according to the first embodiment of the present invention. The compressor comprises a cylinder block constituted by a front block half 1 and a rear block half 2 coupled together and has a suction inlet 3 for receiving a refrigerating medium from a refrigerating circuit (not shown) and a swash plate chamber 4 at the juncture of the front and rear block halves 1 and 2, with the swash plate chamber 4 communicating with the suction inlet 3. The cylinder block has opposite ends to which valve plates 5 and 6 are attached, respectively, and a front housing 7 and a rear housing 8 are attached to the cylinder block over the respective valve plates 5 and 6.

Figure 2:
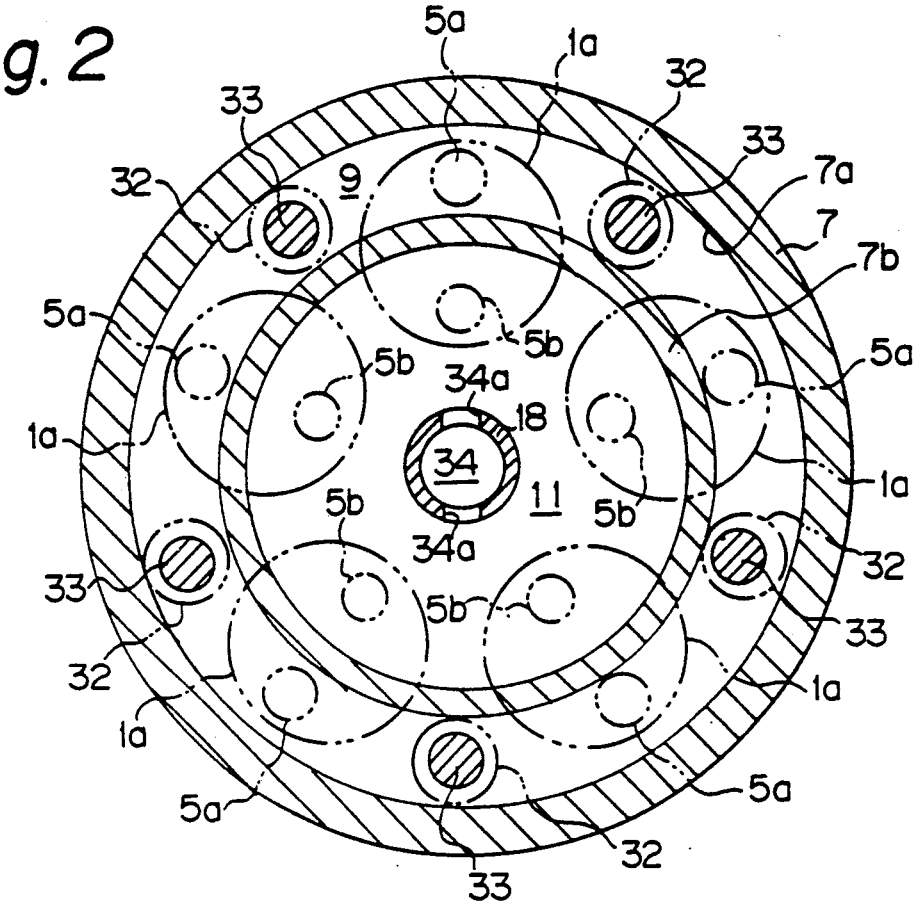
FIG. 2 is a cross-sectional view of the compressor of FIG. 1, taken along the line II—II FIG. 1.

As shown in FIGS. 1 and 2, the front housing 7 has a ring shaped suction chamber 9 in a radially outer region thereof and a discharge chamber 11 in a radially inner region thereof. The front housing 7 has a recess 7*a* at the surface facing to the valve plate 5 and a continuously circular rib 7*b* standing in the recess 7*a*, the circular rib 7*b* separating the suction chamber 9 and the discharge chamber 11. Similarly, the rear housing 8 has a ring shaped suction chamber 10 and a discharge chamber 12.

A discharge outlet 13 is arranged only in the rear housing 8 at a central region thereof, which communicates directly with the discharge chamber 12 of the rear housing 8.

The front and rear block halves 1 and 2 have central axial bores 1*b* and 2*b* extending in line to provide a central axial bore of the cylinder block and a plurality of working bores 1*a* and 2*a* extending in pairs in line, with the pairs of the working bores 1*a* and 2*a* extending parallel to each other around the central axial bores 1*b* and 1*b*. The swash plate chamber 4 intersects the central axial bores 1*b* and 1*b* and the working bores 1*a* and 2*a*. Also, the front and rear block halves 1 and 2 have a plurality of suction passages 32 axially extending through the front and rear block halves 1 and 2 at a radially outer region thereof between the front and rear housings 7 and 8. The suction passages 32 interconnect the swash plate chamber 4 to the suction chambers 9 and 11 in the housings 7 and 8. Fastening bolts 33 conveniently extend in the suction passages 32 to couple the front and rear block halves 1 and 2 together. The working bores 1*a* and 2*a* and the suction passages 32 are shown in phantom in FIG. 2.

As shown in FIG. 1, a drive shaft 18 is inserted in the central axial bore 1*b* and 2*b* of the cylinder block and rotatably supported therein by radial bearings 14 and 15 and seal elements 16 and 17. One end of the drive shaft 18 extends through the front housing 7 and is rotatably supported therein by a radial bearing 19 and a seal element 20. The drive shaft 18 has an intermediate point that passes through the discharge chamber 11 of the front housing and a free end that terminates near the valve plate 6 and faces the discharge chamber 12 of the rear housing 8.

A swash plate 23 is fixed to the drive shaft 18 and rotatably accommodated in the swash plate chamber 23. The swash plate 23 is supported to the front and rear block halves 1 and 2 by thrust bearings 21 and 22.

A plurality of double headed pistons 25 are inserted in the respective pairs of working bores 1*a* and 2*a* to form compression chambers in each of the working bores 1*a* and 2*a* on either side of each of the double headed pistons 25. Each of the double headed pistons 25 is engaged with the swash plate 23 via shoes 24 so that each of the pistons 25 reciprocally move in the respective working bores upon rotation of the swash plate 23.

Each of the valve plates 5 and 6 have suction ports 5*a* and 6*a* with associated valves 26 and 27 for introducing the refrigerating medium from the suction chambers 9 and 10 in the housings 7 and 8 to the compression chambers in the working bores 1*a* and 2*a*, respectively, and discharge ports 5*b* and 6*b* with associated valves 30 and 31 for discharging the compressed refrigerating medium from the compression chambers in the working bores 1*a* and 2*a* to the discharge chambers 11 and 12 of the housings 7 and 8, respectively. Retainers 28 and 29 are arranged to prevent excessive lift of the valves 30 and 31. The valve plate 5 also has a central opening 5*c* to allow the drive shaft 18 to extend therethrough, and the other valve plate 6 has a central opening 6*c* to allow the central axial bore 2*b* to communicate with the discharge chamber 12 of the rear housing 8.

The drive shaft 18 has a solid shaft portion extending from one end to the intermediate point located at the bottom of the recess 7*a* of the front housing 7, and a hollow shaft portion extending from the intermediate point to the other free end. The hollow shaft portion has a discharge passage 34 in the form of an axial hole drilled from the free end of the drive shaft 18 to the intermediate point and radial holes 34*a* opening in the discharge chamber 11 of the front housing 7 for connecting the discharge chamber 11 of the front housing 7 to the discharge chamber 12 of the rear housing 8, i.e., to the discharge outlet 13. The discharge passage 34 has an opening 34*b* at the free end thereof. In this manner, according to the present invention, the discharge passage 34 is formed in the drive shaft 18 and is isolated from a suction system such as the swash plate chamber 4 and the suction passages 32, compared to the prior art.

In operation, the refrigerating medium is introduced from the refrigerating circuit in the swash plate chamber 4 via the suction inlet 3 and then from the swash plate chamber 4 to the suction chambers 9 and 10 of the front and rear housings 7 and 8 via the suction passages 32. The rotation of the drive shaft 18 is transferred to the pistons 25 via the swash plate 23 and the pistons 25 move reciprocally in the working bores 1*a* and 2*a* to effect the suction stroke and the compression stroke. The refrigerating medium is sucked from each suction chamber 9 or 10 to each compression chamber in each of the working bores 1*a* and 2*a* via the suction port 5*a* or 6*a* in the suction stroke. Then the refrigerating medium is compressed and discharged from the compression chambers in the compression stroke to the discharge chamber 11 or 12 in the front and rear housings 7 and 8 via the discharge ports 5*b* and 6*b*. The compressed refrigerating medium in the discharge chamber 11 in the front housing 7 is delivered to the rear housing 8 via the discharge passage 34*a* and 34 and the compressed refrigerating medium from the front and rear discharge chambers 11 and 13 is collected at the rear housing 8. The collected refrigerating medium is finally discharged from the discharge outlet 13 to the refrigerating circuit for recirculation through the refrigerating circuit.

Figure 3:
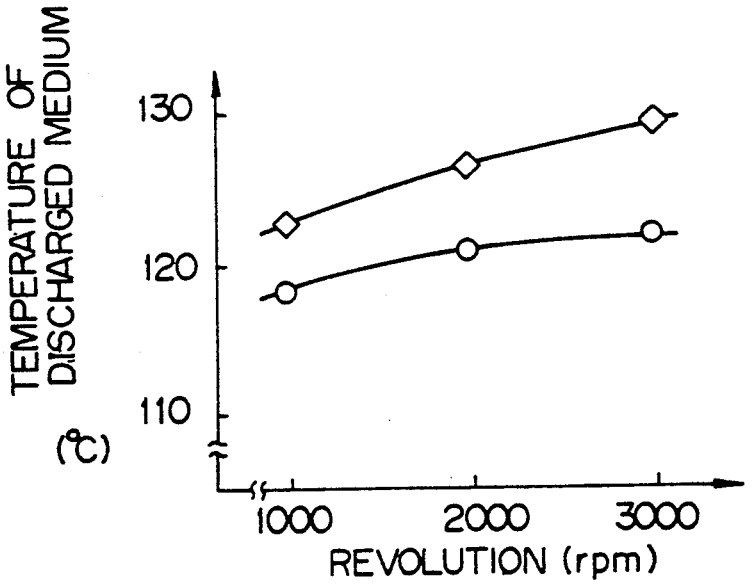
FIG. 3 is a graph showing the relationship of the temperature of the refrigerating medium versus the revolution of the first embodiment and of the prior art.

FIG. 3 shows an experimental result of the temperature (° C.) of the discharged refrigerating medium versus the revolution (rpm) of the drive shaft 18. The curve plotted with the small circles shows the result of the present invention and the curve plotted with the small squares shows the result of a prior art. The temperature (° C.) of the discharged refrigerating medium according to the present invention can be decreased by approximately 5 degrees Celsius in the revolution range of 1,000 to 3,000 rpm. Accordingly, since the discharge passage 34 is far more isolated from the swash plate chamber 4 and the suction passages 32 than the prior art, the refrigerating medium introduced from the refrigerating circuit in the swash plate chamber 4 via the suction inlet 3 and flowing through the swash plate chamber 4 and the suction passages 32 is less affected by the heat of the compressed and thus hot refrigerating medium flowing through the discharge passage 34. Therefore, the refrigerating medium of a relatively low temperature is sucked in the compression chambers and discharged at a relatively low temperature, which may be lower than that in the prior art. Therefore, according to the present invention, the refrigerating medium at a relatively low temperature is delivered to the refrigerating circuit, and a load of the refrigerating circuit may be mitigated and the refrigerating capacity is suitably maintained.

In addition, in the swash plate type compressor according to the present invention, the drive shaft 18 having the discharge passage 34 is obtained by modifying a conventional solid drive shaft into a partially hollow drive shaft 18, and it is possible to arrange the discharge passage 34 such that it does not interfere with the working bores 1*a* and 2*a*, the swash plate chamber 4, and the suction passages 32, and without a significant increase in the outer diameter of the drive shaft 18. Accordingly, it is possible to provide a compressor of a compact design and of a light weight having a desired compression capacity.

Figure 4:
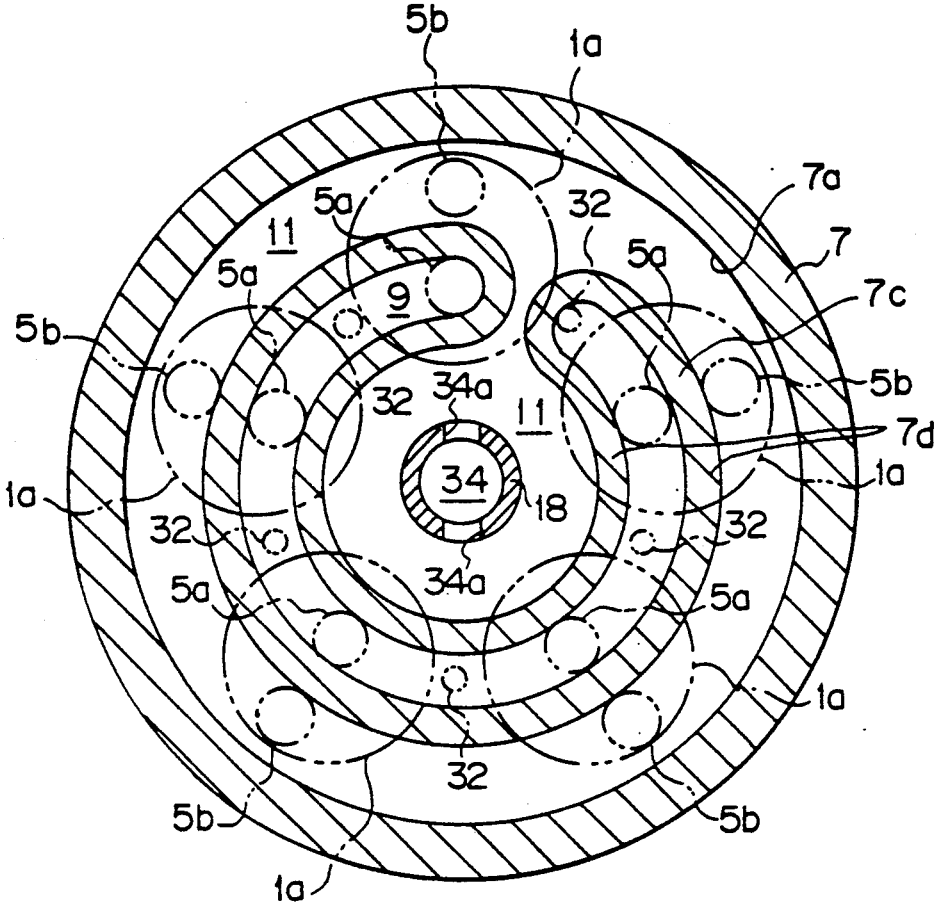
FIG. 4 is a cross-sectional view of a swash plate type compressor according to the second embodiment of the present invention.

FIG. 4 shows the second embodiment of the present invention. The compressor in this embodiment comprises similar components to those of FIG. 1, except for the arrangement of the suction chambers 9 and 10 and the discharge chambers 11 and 12. As shown in FIG. 4, the front housing 7 has a recess 7*a* at the surface facing the valve plate 5 and a semi-circular rib 7*c* standing in the recess 7*a*. The semi-circular rib 7*c* is formed by spaced double walls 7*d* with closed ends to form a space between the double walls 7*d*. The discharge chamber 11 is arranged in the recess 7*a* inside and outside the semicircular rib 7*c*. The suction chamber 9 is arranged in the space between the double walls 7*d* of the semicircular rib 7*c*. The valve ports 5*a* and 5*b* with associated valve elements can be arranged for communication between the suction chamber 9 and the compression chamber and between the compression chamber and the discharge chamber 11, respectively. Also, the rear housing 8 can have similar suction and discharge chambers.

As described, it is possible to modify the arrangement of the suction chambers 9 and 10 and the discharge chambers 11 and 12. However, in the present invention, it is necessary to arrange the discharge chambers 11 and 12 in the front and rear housings 7 and 8 so that the discharge chambers 11 and 12 are interconnected by the discharge passage 34 provided in the drive shaft 18. The suction chambers 9 and 10 can be arranged as desired.

Figure 5:
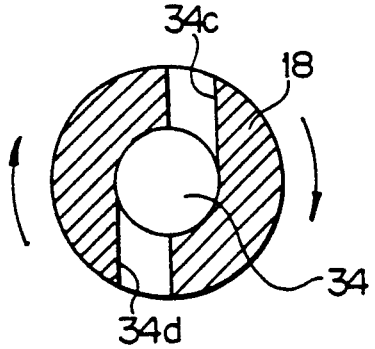
FIG. 5 is a cross-sectional view of a modification of the driving shaft.

FIG. 5 shows an example of the modified driving shaft 18 that has the discharge passage 34 and the radial holes 34*a* opening in the discharge chamber 11 of the front housing 7. The radial holes 34*c* and 34*d* (34*a*) have guide means for assisting a flow of the refrigerating medium from the discharge chamber 11 into the discharge passage 34 in the hollow shaft portion upon the rotation of the drive shaft. In FIG. 5, this guide means comprises an offset of the radial holes 34*c* and 34*d* (34*a*) relative to a radius of the hollow shaft portion. The radial holes 34*c* and 34*d* are offset toward the leading side in view of the rotation of the drive shaft 18 as shown by the arrow.

Figure 6A:
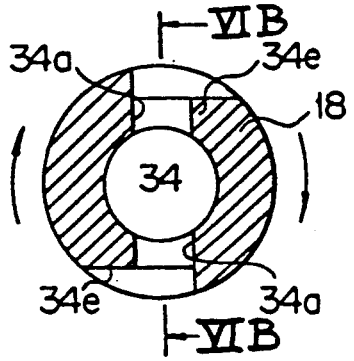
FIGS. 6A and 6B are cross-sectional views of another modification of the driving shaft.
Figure 6B:
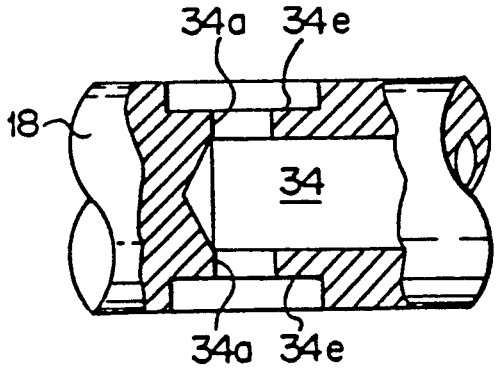

FIG. 6A shows another example of the modified driving shaft 18 having guide means for assisting a flow of the refrigerating medium from the discharge chamber 11 into the discharge passage 34 in the hollow shaft portion. FIG. 6B is a cross-sectional view of the driving shaft 18 taken along the line VIB—VIB in FIG. 6A. In FIGS. 6A and 6B, this guide means comprises guide cutouts 34*e* at a radially outer portion of the radial holes 34*a* extending toward the leading side when viewed from the direction of the rotation of the drive shaft 18.

Figure 7A:
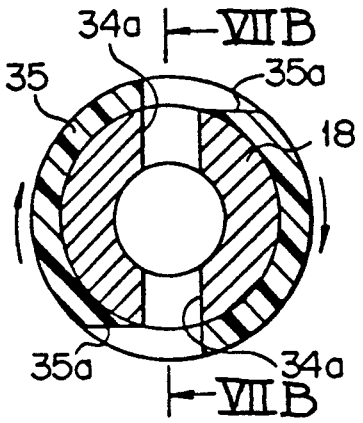
FIGS. 7A and 7B are cross-sectional views of a further modification of the driving shaft.
Figure 7B:
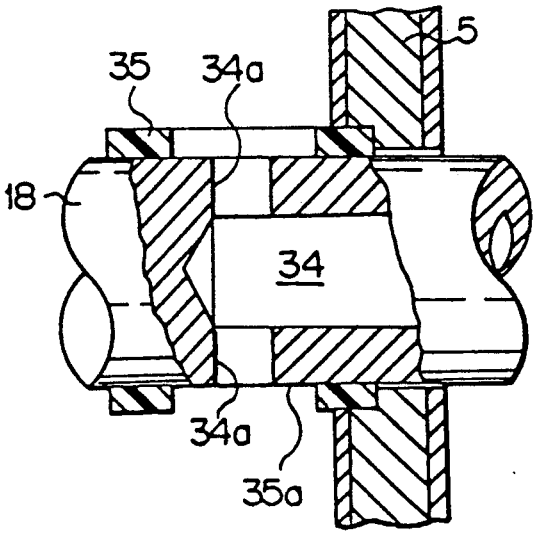

FIG. 7A shows a further example of the modified driving shaft 18 having guide means for assisting a flow of the refrigerating medium from the discharge chamber 11 into the discharge passage 34 in the hollow shaft portion. FIG. 7B is a cross-sectional view of the driving shaft 18 taken along along the line VIIB—VIIB in FIG. 7A. In FIGS. 7A and 7B, this guide means comprises an outer tabular guide member 35 fitted to the hollow shaft portion of the drive shaft 18; the outer tubular guide member 35 having openings 35*a* at a position corresponding with the radial hole 34*a* of the hollow shaft portion. The openings 35*a* preferably have cutouts extending toward the leading side when viewed from the direction of the rotation of the drive shaft 18.

Figure 8A:
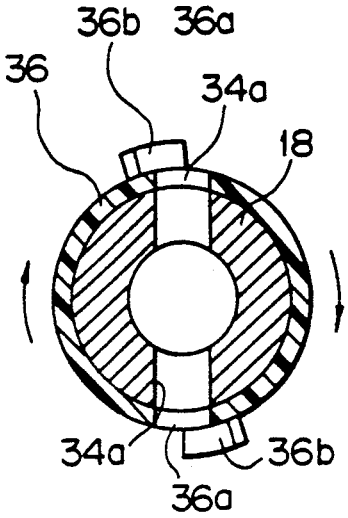
FIGS. 8A and 8B are cross-sectional views of a further modification of the driving shaft.
Figure 8B:
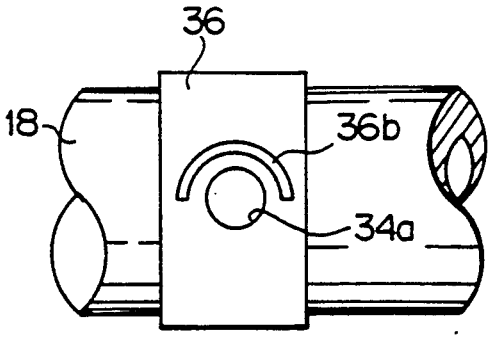

FIG. 8A shows a further example of the modified driving shaft 18 having guide means for assisting a flow of the refrigerating medium from the discharge chamber 11 into the discharge passage 34 in the hollow shaft portion. FIG. 8B is a side view of the driving shaft 18 of FIG. 8A. In FIGS. 8A and 8B, this guide means comprises an outer tubular guide member 36 fitted to the hollow shaft portion of the drive shaft 18, the outer tubular member 36 having openings 36*a* at a position corresponding with the radial hole 34*a* of the hollow shaft portion. Guide fins 36*b* are provided on the outer tubular member 36 at the trailing side when viewed from the direction of the rotation of the drive shaft 18.

By providing the guide means in the radial holes 34*a*, as shown in FIGS. 5 to 8B, a flow of the refrigerating medium from the discharge chamber 11 into the discharge passage 34 in the driving shaft 18 is suitably guided with the rotation of the driving shaft 18. A comparison test is made between the swash plate type compressor in the embodiment of FIG. 1 and the embodiments of the swash plate type compressors having the guide means of FIGS. 5 to 8B. A discharge flow resistance ($kgf/cm^2$) is measured from a difference between the pressure in the discharge chamber 11 of the front housing 7 and the pressure in the discharge passage 34. The result shows that the discharge flow resistance of the embodiment of FIG. 1 is 5 $kgf/cm^2$ and the discharge flow resistance of the embodiment having the guide means is reduced to 0.5 $kgf/cm^2$. Therefore, it has been found that it is possible to decrease the discharge flow resistance by providing the guide means.

Also, in the embodiments of FIGS. 7A and 7B, and 8A and 8B, the outer tubular guide members 35 and 36 also function to increase a bending and torsional resonance point for the driving shaft 18 of the swash plate type compressor. The resonance point in the embodiments having the outer tubular guide members 35 is 300 Hz, whereas the bending and torsional resonance point for the driving shaft 18 of the first embodiments is 100 Hz. By this function, it is possible to improve the strength of the drive shaft 18. Also, in these embodiments, it is possible to use the outer tubular guide members 35 and 36 as a seal means between the drive shaft 18 and the front valve plate 5.

As explained in detail, in the swash plate type compressor according to the present invention, since the discharge passage 34 connecting the discharge chamber 11 of the front housing 7 to the rear housing 8 having the discharge outlet 13 is arranged at least partly in the drive shaft 18, it is possible to decrease the temperature of the discharged refrigerating medium. Accordingly, the refrigerating medium of a relatively low temperature is circulated in the refrigerating circuit including the swash plate type compressor, and the load of the refrigerating circuit may be light and the refrigerating capacity is suitably maintained.

Also, in the swash plate type compressor according to the present invention, since the drive shaft 18 having the discharge passage 34 formed therein is a modification of a solid drive shaft in the conventional design, it is possible to arrange the discharge passage 34 so that it does not interfere with the working bores 1*a* and 2*a*, the swash plate chamber 4, and the suction passages 32, and does not cause a significant increase in the outer diameter of the drive shaft. Accordingly, it is possible to provide a compressor of a compact design and light weight having a desired compression capacity.

Figure 9:
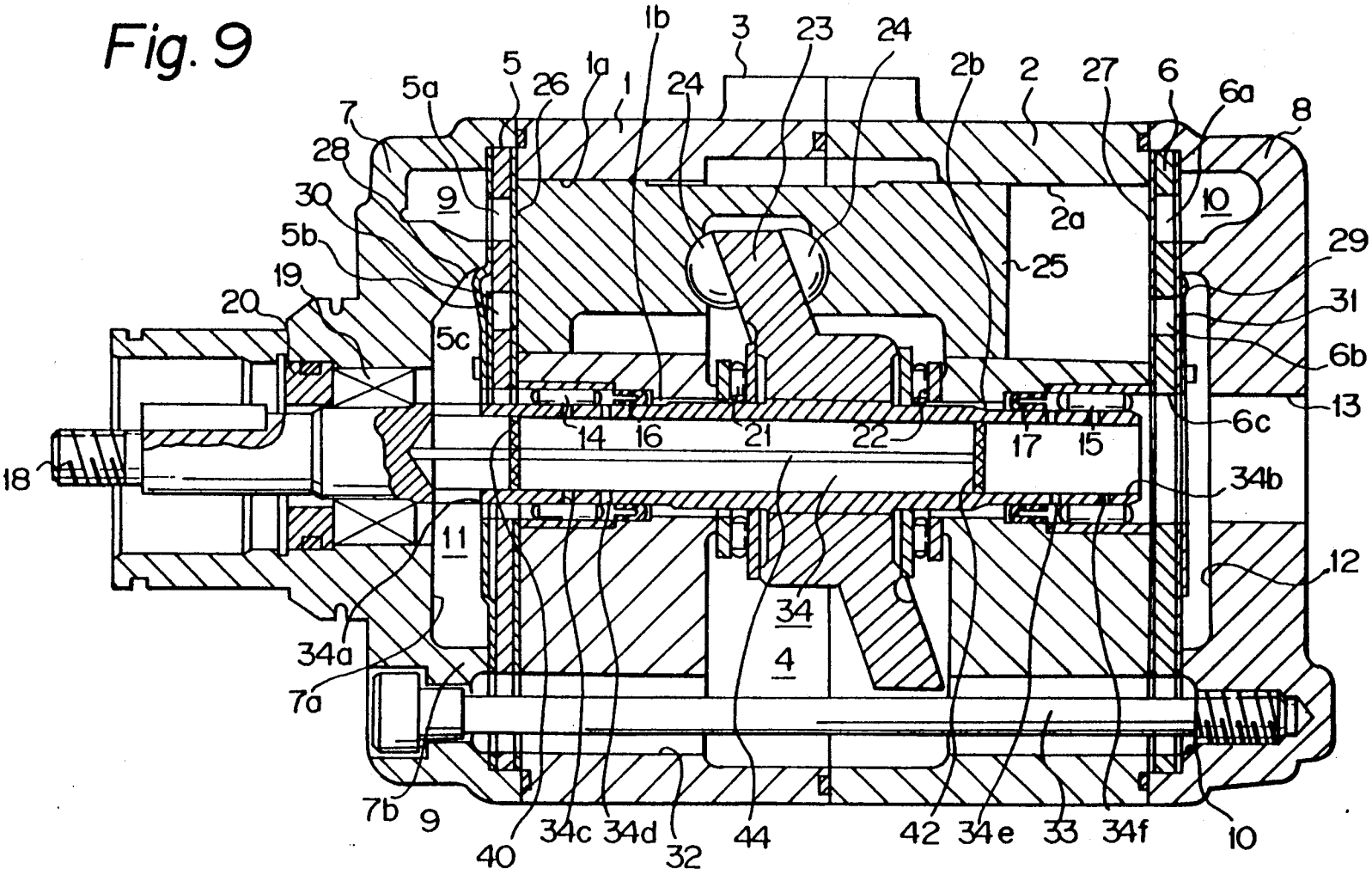
FIG. 9 is a cross-sectional view of a swash type compressor according to the third embodiment of the present invention.
Figure 10:
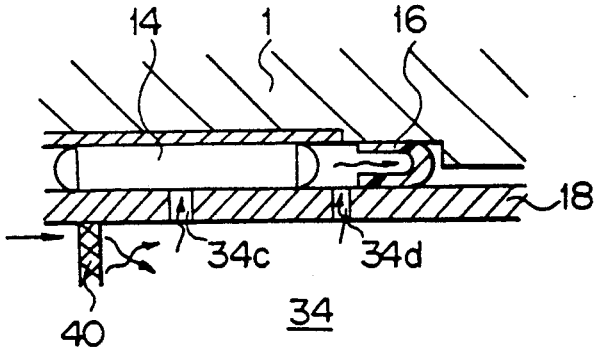
FIG. 10 is a partially enlarged view of the compressor of FIG. 9.

FIGS. 9 and 10 show the third embodiment of the present invention. The swash plate type compressor in this embodiment comprises a cylinder block constituted by a front block half 1 and a rear block half 2 coupled together having a suction inlet 3 and a swash plate chamber 4, valve plates 5 and 6, and front and rear housings 7 and 8 with suction chambers 9 and 10 and discharge chambers 11 and 12. The front and rear block halves 1 and 2 have central axial bores 1*b* and 2*b*, working bores 1*a* and 2*a*, and suction passages 32. A drive shaft 18 is inserted in the central axial bore 1*b* and 2*b* of the cylinder block and rotatably supported therein by radial bearings 14 and 15 and seal elements 16 and 17. A swash plate 23 is fixed to the drive shaft 18 and rotatably accommodated in the swash plate chamber 23. Double headed pistons 25 are inserted in the working bores 1*a* and 2*a* for forming compression chambers in each of the working bores 1*a* and 2*a*.

The drive shaft 18 has a solid shaft portion extending from one end to the intermediate point located at the bottom of the recess 7*a* of the front housing 7, and a hollow shaft portion extending from the intermediate point to the other free end. The hollow shaft portion has a discharge passage 34 in the form of an axial hole drilled from the free end to the intermediate point and radial holes 34*a* opening in the discharge chamber 11 of the front housing 7 for connecting the discharge chamber 11 of the front housing 7 to the discharge chamber 12 of the rear housing 8. The discharge passage 34 has an opening 34*b* at the free end thereof.

As shown in FIGS. 9 and 10, the bearing 14 is arranged in the central axial bore 1*b* of the cylinder block about the drive shaft 18 between the intermediate point and the swash plate 23 and the seal element 16 is arranged between the bearing 14 and the swash plate 23. Also, the bearing 15 is arranged in the central axial bore 2*b* of the cylinder block about the drive shaft 18 between the swash plate 23 and the open end 34*b* of the drive shaft 18 and the seal element 17 is arranged between the bearing 15 and the swash plate 23.

The hollow shaft portion of the drive shaft 18 has oil holes 34*c* to 34*f* near the bearings 14 and 15 and the seal elements 16 and 17 for lubricating the bearings 14 and 15 and the seal elements 16 and 17 with an oil contained in a refrigerating medium to be compressed. In addition, metal nets 40 and 42 are arranged in the hollow shaft portion of the drive shaft 18 at a position on the upstream side of the bearings 14 and 15, respectively, for causing a turbulent flow in the discharge passage 34 in the drive shaft 18. The metal nets 40 and 42 are connected to a rod 44 that extends to the bottom of the discharge passage 34 and anchored thereat to fixedly support the metal nets 40 and 42 in the discharge passage 34.

In operation, the compressed refrigerating medium in the discharge chamber 11 in the front housing 7 is delivered to the rear housing 8 via the discharge passage 34 and the collected refrigerating medium is discharged from the discharge outlet 13 of the rear housing 8. The metal nets 40 and 42 located on the upstream side of the bearings 14 and 15 cause a turbulent flow of the refrigerating medium flowing in the discharge passage 34 in the drive shaft 18, as shown in FIG. 10. Therefore, lubricating oil contained in the refrigerating medium is separated from the refrigerating medium, and adhered to the inner wall of the discharge passage 34. The lubricating oil with the refrigerating medium is thus supplied from the oil hole 34*c* on the downstream side of the metal net 40 to the bearing 14, and from the oil hole 34*d* to a space between the bearing 14 and the seal element 16, as shown in FIG. 10. Also, the lubricating oil with the refrigerating medium is supplied from the oil hole 34*e* on the downstream side of the metal net 42 to a space between the seal element 17 and the bearing 15, and from the oil hole 34*f* to the bearing 15.

The lubricating oil with the refrigerating medium supplied from the oil hole 34*d* or 34*e* to a space between the bearing 14 or 15 and the seal element 16 or 17 also functions to expand the rubber seal element 16 or 17 having the U-shaped cross-section between the outer surface of the drive shaft and the inner surface of the central axial bores 1*b* and 2*b* of the cylinder block to prevent the regrigerating medium from leaking into the swash plate chamber 4, as shown in FIG. 10.

When the revolution of the drive shaft becomes higher, the metal nets 40 and 42 stirs the refrigerating medium to cause a stronger turbulent flow in the discharge passage 34 so that the lubricating oil adheres more to the inner wall of the discharge passage 34. The lubricating oil is separated by the metal nets 40 and 42 is further adhered to the inner wall of the discharge passage 34 by the increasing centrifugal force. The amount of the lubricating oil supplied from the oil holes 34*c* to 34*f* thus increases generally in proportion to the revolution of the driving shaft 18. Accordingly, the radial bearings 14 and 15 and the seals 16 and 17 can be suitably lubricated and the working life of the swash plate type compressor can be prolonged.

We claim:

1. A swash plate type compressor comprising:

a cylinder block having opposite ends, a central axial bore, a plurality of working bores extending parallel to each other around the central axial bore, a suction inlet, and a swash plate chamber intersecting the central axial bore and the working bores;

valve plates attached to the ends of the cylinder block, respectively, the valve plates having valve ports and associated valve elements to cover and uncover the valve ports;

first and second housings attached to the ends of the cylinder block over the valve plates, respectively; each of the first and second housings having at least a discharge chamber formed between each of the first and second housings and each of the valve plates;

a drive shaft inserted in the central axial bore of the cylinder block and rotatably supported therein;

a swash plate accommodated in the swash plate chamber and fixed to the drive shaft for rotation therewith;

a plurality of double headed pistons inserted in the respective working bores for forming compression chambers in each of the working bores on either side of each of the double headed pistons and engaged with the swash plate via shoes so that the pistons reciprocally move in the respective working bores upon a rotation of the swash plate;

at least one suction passage for introducing a medium from the suction inlet to the compression chambers via the swash plate chamber; and a discharge passage for connecting the discharge chamber in one of the first and second housings to the other housing;

wherein the discharge passage is arranged at least partly in the drive shaft.

2. A swash plate type compressor according to claim 1, wherein each of the first and second housings has a discharge chamber communicable to the compression chambers via the valve plate and a suction chamber communicable to the compression chambers via the valve plate.

3. A swash plate type compressor according to claim 2, wherein each of the first and second housings has a recess and a continuously circular rib standing in the recess whereby the discharge chamber is arranged in the recess inside the circular rib and the suction chamber is arranged in the recess outside the circular rib.

4. A swash plate type compressor according to claim 2, wherein each of the first and second housings has a recess and a semi-circular rib standing in the recess, the semi-circular rib being formed by spaced double walls with closed ends to form a space therebetween whereby the discharge chamber is arranged in the recess inside and outside the semi-circular rib and the suction chamber is arranged in the space between the double walls of the semi-circular rib.

5. A swash plate type compressor according to claim 2, wherein the drive shaft has opposite ends, an intermediate point, a solid shaft portion extending from one of the ends to the intermediate point, and a hollow shaft portion extending from the intermediate point to the other end, the hollow shaft portion having an axial hole and at least one radial hole for constituting the discharge passage in which the axial hole has an open end at the other end, and the at least one radial hole opens in the discharge chamber other than that having a discharge outlet.

6. A swash plate type compressor according to claim 5, wherein the at least one radial hole has a guide means for assisting a flow of the medium from the discharge chamber into the axial hole of the hollow shaft portion upon rotation of the drive shaft.

7. A swash plate type compressor according to claim 6, wherein the guide means comprises an offset of the at least one radial hole relative to a radius of the hollow shaft portion.

8. A swash plate type compressor according to claim 6, wherein the guide means comprises a cutout at a radially outer portion of the at least one aperture toward the leading side when viewed from the direction of the rotation of the drive shaft.

9. A swash plate type compressor according to claim 6, wherein the guide means comprises a guide member fitted to the hollow shaft portion, the guide member having a cutout at the leading side of the hollow shaft portion when viewed from the direction of the rotation of the drive shaft.

10. A swash plate type compressor according to claim 6, wherein the guide means comprises a guide member fitted to the hollow shaft portion; the guide member having a guide fin at the trailing side of the hollow shaft portion when viewed from the direction of the rotation of the drive shaft.

11. A swash plate type compressor according to claim 5, wherein at least one bearing is arranged in the central axial bore of the cylinder block about the driver shaft between the intermediate point and the other end of the drive shaft.

12. A swash plate type compressor according to claim 11, wherein a first bearing is arranged in the central axial bore of the cylinder block about the drive shaft between the intermediate point and the swash plate, and a second bearing is arranged in the central axial bore of the cylinder block about the drive shaft between the swash plate and the other end of the drive shaft.

13. A swash plate type compressor according to claim 12, wherein the solid shaft portion of the drive shaft extends through one of the first and second housings, and a third bearing is arranged in the housing about the solid shaft portion of the drive shaft.

14. A swash plate type compressor according to claim 11, wherein the hollow shaft portion has at least one oil hole near the bearing for lubricating the bearing with oil contained in a medium to be compressed.

15. A swash plate type compressor according to claim 14, wherein a seal means is arranged between the bearing and the swash plate and the hollow shaft portion has at least one oil hole for lubricating the bearing and the seal means with oil contained in a medium to be compressed.

16. A swash plate type compressor according to claim 14, wherein a means is arranged in the hollow shaft portion of the drive shaft at a position on the upstream side of the bearing to produce a turbulent flow of the refrigerating medium flowing in the discharge passage in the drive shaft.

17. A swash plate type compressor according to claim 5, wherein a seal means is arranged in the central axial bore of the cylinder block about the drive shaft between each of the discharge chambers and the swash plate chamber.

* * * * *